US010151508B2

(12) United States Patent
Irvin et al.

(10) Patent No.: US 10,151,508 B2
(45) Date of Patent: Dec. 11, 2018

(54) HIGH PRESSURE, HIGH TEMPERATURE, ON DEMAND WATER HEATER

(71) Applicants: James H. Irvin, Hoover, AL (US); William E. Farthing, Grant, AL (US); Larry G. Felix, Pelham, AL (US); Todd R. Snyder, Birmingham, AL (US)

(72) Inventors: James H. Irvin, Hoover, AL (US); William E. Farthing, Grant, AL (US); Larry G. Felix, Pelham, AL (US); Todd R. Snyder, Birmingham, AL (US)

(73) Assignee: Gas Technology Institute, Des Plaines, IL (US)

( * ) Notice: Subject to any disclaimer, the term of this patent is extended or adjusted under 35 U.S.C. 154(b) by 103 days.

(21) Appl. No.: 15/082,859

(22) Filed: Mar. 28, 2016

(65) Prior Publication Data

US 2016/0282010 A1 Sep. 29, 2016

Related U.S. Application Data

(60) Provisional application No. 62/139,495, filed on Mar. 27, 2015.

(51) Int. Cl.
*F24H 1/08* (2006.01)
*F22B 37/62* (2006.01)
(Continued)

(52) U.S. Cl.
CPC ..... *F24H 1/08* (2013.01); *F22B 23/00* (2013.01); *F22B 37/62* (2013.01); *F24H 1/107* (2013.01);
(Continued)

(58) Field of Classification Search
CPC ..... C10L 9/086; F22B 23/00; F22B 37/62; F24H 1/08; F24H 1/107; F24H 1/162; F24H 9/1818
See application file for complete search history.

(56) References Cited

U.S. PATENT DOCUMENTS 1,555,338 A * 9/1925 Vaughan ..... F24D 17/00 236/25 R
1,682,674 A * 8/1928 Hedlund ..... F01K 3/004 122/35
(Continued)

FOREIGN PATENT DOCUMENTS

DE 2 100 278 7/1972
DE 2100278 A1 * 7/1972 ..... F24D 17/00
(Continued)

OTHER PUBLICATIONS

Bolger, Pressure Control, Oct. 23, 2010, https://www.processingmagazine.com/ext/resources/assets/whitepapers/archives/p/PlastOMaticWP.pdf.*
(Continued)

*Primary Examiner* — Steven B McAllister
*Assistant Examiner* — Steven Anderson, II
(74) *Attorney, Agent, or Firm* — Pauley Erickson & Kottis

(57) ABSTRACT

A compact, on-demand system to produce high pressure (≤5,000 psig) and high temperature (≤450° C.) water or other liquids which maintains single-phase flow throughout the system utilizing low-cost, thick-wall tubing and thereby negate the requirement to design the unit as a boiler or adhere to coded pressure vessel design requirements. This design can also replace a conventional boiler for the generation of hot water as well as low and high pressure steam.

24 Claims, 10 Drawing Sheets

(51) Int. Cl.

| | |
|---|---|
| ***F24H 1/10*** | (2006.01) |
| ***F22B 23/00*** | (2006.01) |
| ***F24H 1/16*** | (2006.01) |
| ***F24H 9/18*** | (2006.01) |
| *C10L 9/08* | (2006.01) |

(52) U.S. Cl.
CPC ..... *F24H 1/162* (2013.01); *F24H 9/1818* (2013.01); *C10L 9/086* (2013.01)

(56) References Cited

U.S. PATENT DOCUMENTS 1,846,047 A * 2/1932 Brown ..... F22D 11/00 122/1 C
2,452,214 A * 10/1948 Vogel ..... F24H 9/1818 219/526
2,969,451 A * 1/1961 Logan ..... F24D 17/00 122/13.3
3,626,907 A * 12/1971 Slattery ..... F22B 3/04 122/35
4,680,446 A * 7/1987 Post ..... F24D 17/00 122/13.3
5,222,185 A * 6/1993 McCord, Jr. ..... F22B 1/30 219/601
2007/0119225 A1* 5/2007 McFarland ..... H01H 11/0062 73/1.01
2009/0180768 A1* 7/2009 Moore ..... F24D 17/0078 392/485
2010/0031899 A1* 2/2010 Williams ..... F24H 1/185 122/13.01
2012/0037097 A1* 2/2012 Schroeder ..... F22D 1/003 122/1 C
2014/0262727 A1 9/2014 Felix et al.
2015/0040672 A1* 2/2015 Meyer ..... G01L 19/0092 73/700
2015/0346740 A1* 12/2015 Whitehouse ..... F24H 9/2007 236/12.1
2016/0113431 A1* 4/2016 Sotome ..... H05B 3/44 126/369

FOREIGN PATENT DOCUMENTS

| | | | |
|---|---|---|---|
| DE | 100 41 154 | A1 | 3/2002 |
| EP | 2 080 960 | A2 | 7/2009 |
| EP | 2711648 | * | 9/2013 |
| EP | 2 711 648 | A1 | 3/2014 |
| WO | WO 2014/136826 | A1 | 9/2014 |

OTHER PUBLICATIONS

Navy, Construction Mechanic, Advanced, Jul. 23, 2013, https://ia600906.us.archive.org/1/items/USNavyCourseAviationMaintenanceRatingsNAVEDTRA14022/US%20Navy%20course%20-%20Construction%20Mechanic,%20Advanced%20NAVEDTRA%2014050.pdf.*

* cited by examiner

HIGH PRESSURE, HIGH TEMPERATURE, ON DEMAND WATER HEATER

CROSS REFERENCE TO RELATED APPLICATION

This Application claims the benefit of U.S. Provisional Patent Application Ser. No. 62/139,495, filed on 27 Mar. 2015. The U.S. Provisional Patent Application is hereby incorporated by reference herein in its entirely and is made a part hereof, including but not limited to those portions which specifically appear hereinafter.

BACKGROUND OF THE INVENTION

Field of the Invention

This invention is directed to a high-energy, high-efficiency system which is capable of continuously delivering high pressure, high temperature (HPHT) liquid water, pure steam or water vapor, or selectable proportions of liquid water and steam or water vapor.

Discussion of Related Art

In the development of an innovative, rapid, continuous process for hydrothermally carbonizing biomass employing pressure and heat within a dynamic reactor system, a novel high pressure, high temperature (HPHT), on-demand water heater was developed. A device of this design can continuously deliver liquid water at temperatures from ambient up to and beyond the critical point of water (up to 450° C.) for any process that requires HPHT water at or above a local water saturation pressure. While this innovative on-demand water heater enabled the highly-efficient production of hydrothermally carbonized biomass in a twin-screw extruder, many other applications of this novel type of water heater suggest that it could be employed in place of conventional capital-intensive boiler-based technologies for providing HPHT water. In particular, HPHT water can be transported to locations apart from the water heater, using heat-efficient technology developed for this device where it can be vaporized to provide low or high-grade steam for a variety of industrial processes including sterilization, chemical processes, a fluidizing medium for fluidized-bed gasification, and power production

SUMMARY OF THE INVENTION

The nature of the invention is a high-energy, high-efficiency system which continuously delivers high pressure, high temperature (HPHT), liquid water for use with many processes while concurrently not producing or delivering localized steam or vapor. The result of the invention is that high temperature water, up to 450° C. and 5000 psig (34.47 MPa), can be produced at or near the point of use for research and development, and a variety of research, commercial and industrial applications and not require the installation of boilers, pressure vessels or high pressure and high temperature piping systems. One novel feature of this system is that HPHT water produced by this system can be transported to locations apart from the water heater, using heat-efficient technology developed for this device where the HPHT water can be converted to provide low or high-grade steam for a variety of industrial processes including sterilization, chemical processes, gasification and power production. Low grade steam can readily be produced by flashing to a lower pressure, to produce lower quality steam, a mixture of steam and liquid phase water. High grade, also known as pure, steam can be produced through additional heating in the invention also described herein. The system components described in the preferred embodiments include a novel backpressure regulator which enables the creation of system pressure that is independent of system temperature. Due to the unique nature and configuration of the system, it is unaffected by multiphase flow at the discharge which standard practice teaches will typically engender process upsets.

In a preferred embodiment, the high pressure, high temperature water heater of this invention includes a pump, an accumulator, a first-stage water heater, a second-stage water heater, a backpressure regulator, and an output. It should be understood that this invention may not necessarily include all of the above listed primary components and may include additional and/or alternative components.

In an embodiment of this invention, water is filtered and provided to a water softener to reduce a mineral content of the water. Water from the water softener is then directed to the pump which provides pressurization and volumetric metering of water. The pump preferably is a positive-displacement variable stroke piston pump. From the pump, water is delivered to the accumulator to dampen pulsations and pressure spikes produced by the pump to provide a constant, even flow of water. Water from the accumulator preferably then passes through a check valve to prevent fluid backflow and pressure loss. After the check valve, the water passes to the first-stage high watt density water heater. In an embodiment of this invention, the first-stage high watt density water heater includes a heater liner enclosing a coiled arrangement of tubing passing around a plurality of high watt density heaters. Water passes through the tubing and is heated by the plurality of high watt density heaters.

In preferred embodiments, a heat conducting powder, such as a copper powder, fills a void in the heater liner between the tubing and the heaters. The conductive powder facilitates a heat transfer from the high watt density heaters to water flowing within the tubing. In another preferred embodiment, an appropriate metal that liquefies at or below the temperatures utilized for heating water can be employed to fill the void in the heater liner between the tubing and the heaters. In a preferred embodiment, the tubing is coiled and sized to create turbulent flow of the water to enable efficient heat removal from walls of tubing to the water flowing in the tubing.

The first-stage high watt density water heater may further comprise a band heater positioned around the heater liner and with insulation and an insulated container surrounding the band heater. The band heater, the insulation and the insulated container minimize heat loss. From the first-stage high, watt density water heater, the water preferably passes through a series of valves which may be used during system startup and shutdown. The water then passes to the second-stage inline water heater.

The first stage heater is intended to have a high thermal mass while the second stage heater intentionally has a low thermal mass. Likewise, the first stage heater creates the largest temperature increase while the Second stage heater is designed to provide a low temperature increase for fine control. The large thermal mass of the first stage heater allows it to accommodate to flow rate changes more easily with minimal overshoot when abrupt or intentional reductions in flow rate occur. Likewise, the large thermal mass of the first stage heater and the ability to transfer high watt density thermal energy from each small surface area heater sheath to the large surface area coiled tubing due to the large mass of high-heat conductivity of the very fine copper powder that surrounds each heater ensures a lower bulk temperature loss when liquid flow rates are abruptly or intentionally increased.

Thus, this approach significantly reduces the chances of an overpressure condition due to loss of flow. In this system, the temperature of the copper powder is precisely controlled. Therefore, a loss of water flow does not require operator intervention because the feedback-regulated control system is designed to accommodate such an eventuality. This differentiates the HPHT water heater from conventional boiler technology where an abrupt loss or interruption of water flow can quickly lead to over temperature conditions and equipment failure.

The second stage heater intentionally has a low thermal mass to reduce temperature overshoot risks and allow it to react quickly to temperature fluctuations.

In a preferred embodiment, the second stage inline heater comprises a pair of heaters connected serially and assembled such that an outer surface of a heater sheath is fully enclosed by process tubing and thereby contact water flowing through the annulus defined by the exterior of the heater sheath and the interior surface of the process tubing. The high pressure, high temperature water heater of this invention further includes a backpressure regulator connected downstream of the second-stage inline heater, wherein the backpressure regulator handles single and multiphase flow. The system of this invention also includes an output.

In another embodiment of this invention, the high pressure, high temperature water heater may further include a novel high pressure, high temperature water vaporizer connected to the output of the high pressure, high temperature water heater. This high pressure, high temperature water vaporizer functions differently than conventional boiler-based steam generators in that it includes a chamber with an integrated heating element that permits a portion of the high pressure and high temperature liquid water produced by the high pressure, high temperature water heater to flash to steam and another portion to remain as water. The high pressure, high temperature water vaporizer further includes a suitable pressure-reducing valve or a backpressure regulator to allow for the exhaust of steam for use in a desired process.

BRIEF DESCRIPTION OF THE DRAWINGS

These and other objects and features of this invention will be better understood front the following detailed description taken in conjunction with the drawings, wherein.

DESCRIPTION OF PREFERRED EMBODIMENTS

Figure 1:
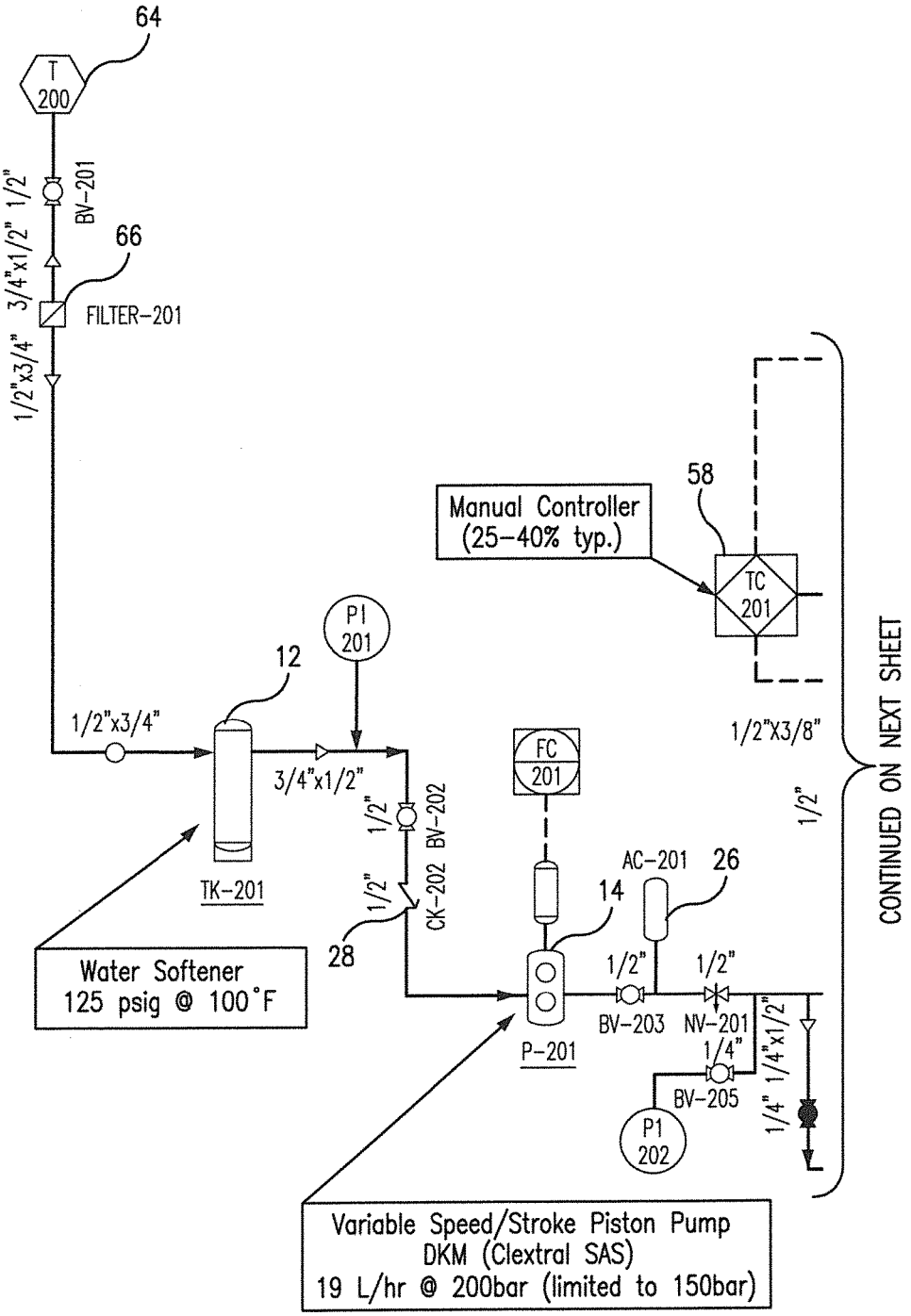
FIG. 1 is a schematic drawing of a flow diagram of a high pressure, high temperature on-demand water heater system according to an embodiment of this invention.
Figure 1:
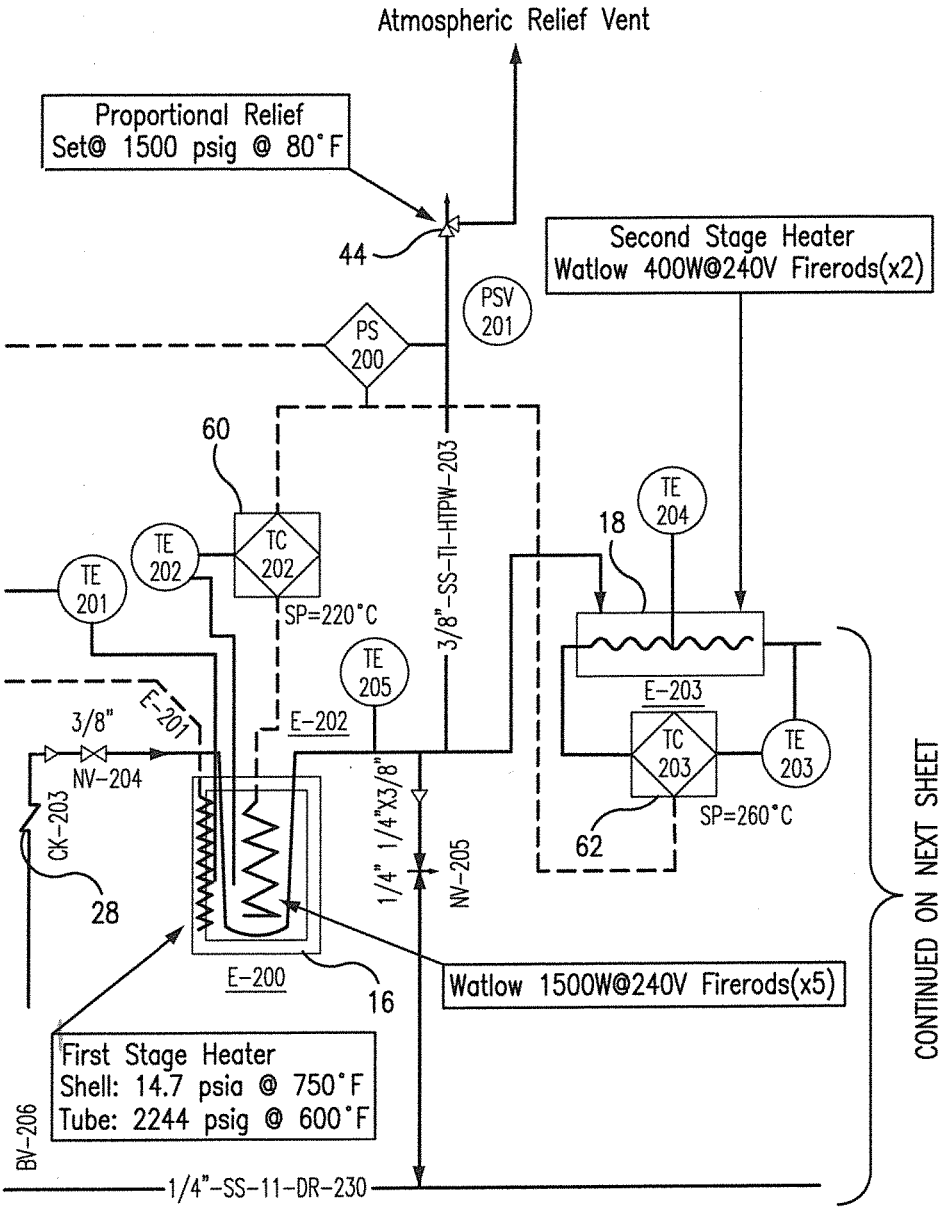
Figure 1:
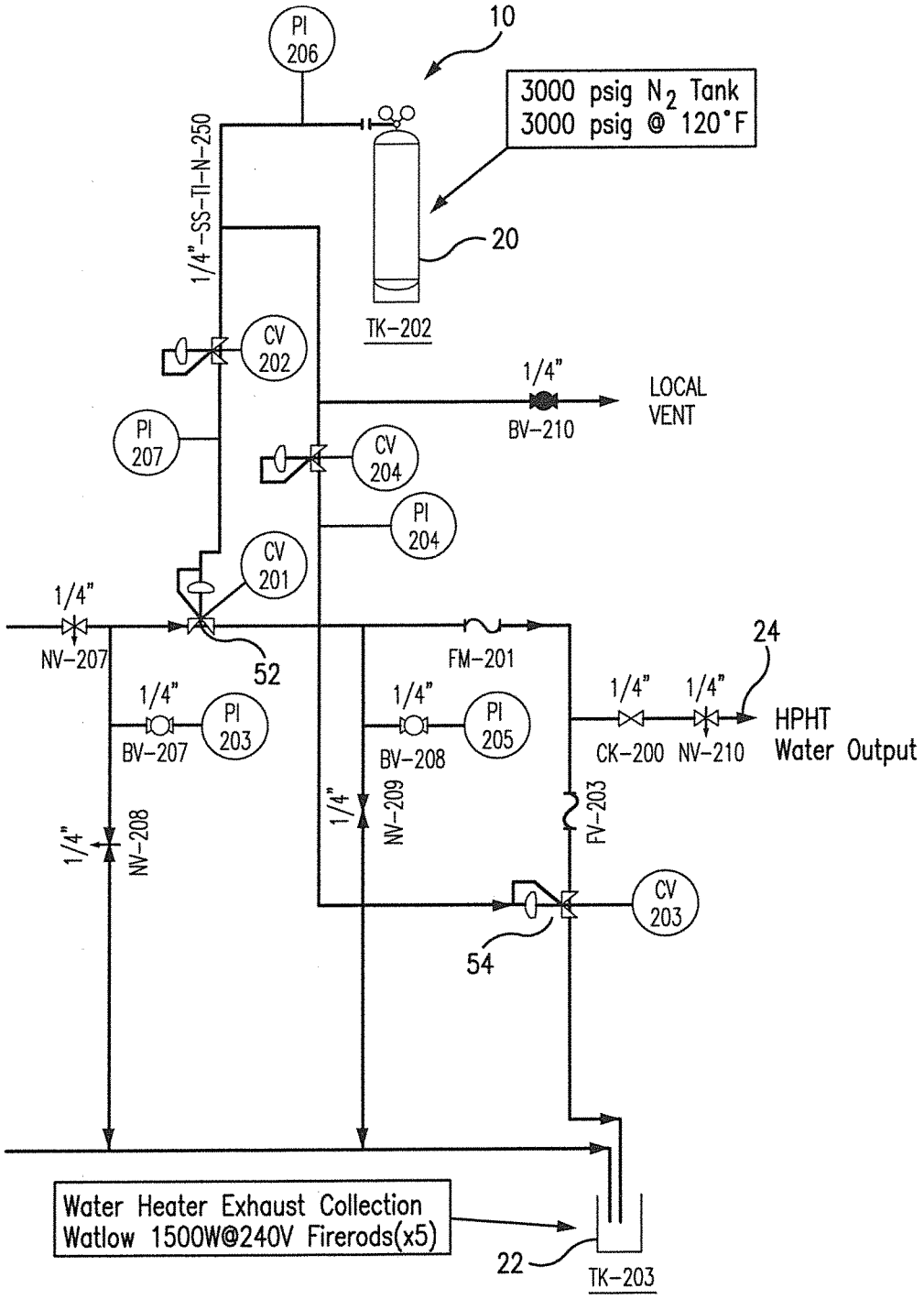

FIG. 1 shows a process and instrumentation diagram (P&ID) of a high pressure, high temperature, on-demand water heater system 10 according to an embodiment of this invention. In this embodiment, major subsystems of the high pressure, high temperature, on-demand water heater 10 include a water softener 12, a pump 14, a novel first-stage water heater 16 including heating elements (E-201 and E-202), an in-line second-stage water heater 18 (E-203), a source of internal pressurization 20 (TK-202), a water heater exhaust collector 22 (TK-203), and a back pressure regulator 52. In the embodiment of FIG. 1, an output 24, also known as a point of delivery, provides the high pressure, high temperature water for a process, such as a process for hydrothermally carbonizing biomass employing pressure and heat within a dynamic reactor system. However, the system 10 of this invention may be used, with any type of process requiring high pressure, high temperature water. Please note that the figures of this application include dimensions and/or components with characteristics and operating parameters, these dimensions and identified components comprise embodiments of this invention and should not be construed as limiting the invention of this application to the dimensions and/or identified components. A person having skill in the art will understand that the invention can be varied considerably without departing from the basic principles of the invention.

In the embodiment of FIG. 1, a water source is provided to the system 10 by an input 64. Depending on the water source, the water may then pass through a filter 66 to remove any unwanted particulates or other matter. Water from the input 64 may also pass through valving arranged to control the pressure or flow rate of the water.

The water then passes through the water softener 12. The water softener 12 of this invention reduces the mineral content of the water to negligible levels to prevent the formation of scale and internal deposits within the system 10. Alternatively, depending on a quality and mineral content of the water source, the system 10 of this invention may not include the water softener 12.

In the embodiment shown in FIG. 1, water passing through the water softener 12 passes to the pump 14. The flow path from the water softener 12 to the pump 14 may include one or more valves or other devices for controlling the How and pressure of the water. In a preferred embodiment of this invention, the pump 14 comprises a positive displacement variable speed/stroke piston pump 14 that controls pressurization and volumetric metering of the pressurized and injected fluid. In one embodiment the positive displacement, variable speed, variable stroke piston pump 14 is preferably capable of continuously operating at pressures up to 200 bar with a metered flow of 6-19 Liters per hour. However, the system 10 of this invention is not limited to this type of pump and may use another type of pump with other specifications. In a preferred embodiment, the pump 14 is controlled with a variable frequency drive pump controller.

In the embodiment of FIG. 1, directly downstream of the pump 14 is an accumulator 26. The accumulator 26 is preferably located to damp any pulsations and pressure spikes produced by the pump 14 to provide a constant, even flow of water into the remainder of the system 10.

After pressurization, water is directed through one or more high pressure, ambient temperature check valves 28 to prevent fluid backflow and pressure loss during operation.

In the embodiment shown in FIG. 1, once the pressurized and metered fluid has moved beyond a first set of check valves 28, the water passes to the first-stage water heater 16. In a preferred embodiment, the first stage heater 16 comprises a first-stage high watt density heater. FIGS. 2*a*-4*f* show an embodiment and components of the first-stage high watt density heater 16 that was specifically developed for this application. The first-stage high watt density heater 16 of this invention preferably includes an insulated containment vessel 30, insulation 32, a band heater 34, a heater liner 36, conductive powder 38, tubing 40 and a heater 42.

Figures 3A, 3B:
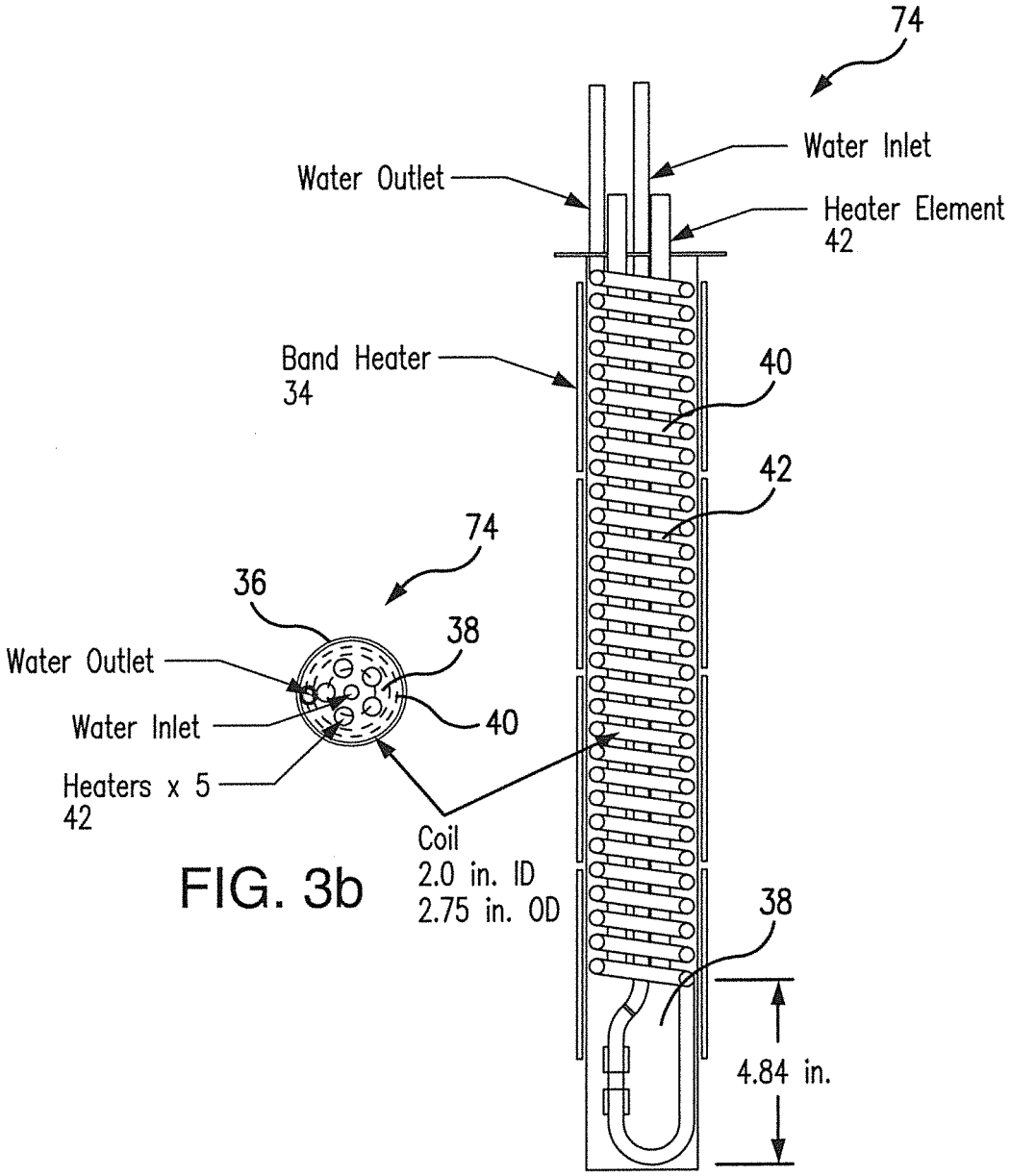
FIG. 3*a* is a side cross-sectional view of an internal heating section of the first-stage heater according to an embodiment of this invention.
FIG. 3*b* is a top cross-sectional view of the internal heating section shown in FIG. 3*a*.

An internal heating section 74 of the first-stage high watt density water heater 16 is best shown in FIGS. 3*a* & 3*b*. In this embodiment the first stage water heater 16 provides high heat transfer from high watt density heaters 42 positioned in a pentagonal arrangement within the coiled heavy wall stainless steel tubing 40 that is filled with packed very fine spherical copper powder in order to provide efficient transfer of heat to the coiled stainless steel tubing 40 and thereby to the water flowing through the stainless steel tubing 40 to heat the water to high temperatures. A preferred embodiment of the first-stage high watt density heater 16 provides up to 12.5 kW of power via resistance heaters which by the superior conduction provided by the packed very fine spherical copper particles is transferred into the water with low loss of thermal energy.

Figure 4A:
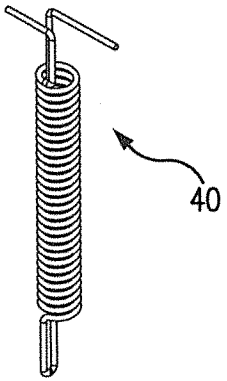
FIG. 4*a* is an isometric view of a coil of the first-stage heater shown in FIG. 3*a*.
Figure 4B:
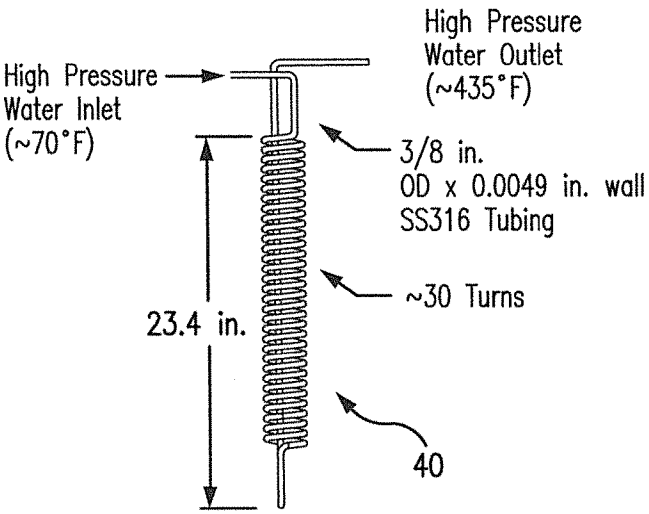
FIG. 4*b* is a side view of the coil of the first-stage heater shown in FIG. 3*a*.

As shown separately in FIGS. 4*a* & 4*b*, the tubing 40 comprises a length of coiled heavy wall stainless steel tubing having the dimensions shown in FIG. 4*b*. Other embodiments exist in which other appropriate metals can be employed to create the coiled tubing 40. In this embodiment, the heavy wall stainless steel tubing 40 is sized to create turbulent flow and enable efficient heat removal from the walls of the tubing. The turbulent flow in this preferred embodiment provides for the efficient transfer of heat away from the tube wall to water flowing past which minimizes nucleation and film boiling and allows for higher temperance increases in the water than would typically be expected from standard teaching. Another consideration is that the rapid transfer of heat from small surface area high watt density heaters to the larger surface area tubing reduces overall heat flux which thereby reduces the possibility of nucleate and film boiling. However, it should be understood that the tubing 40 is not limited to the shape or dimensions shown and described and may comprise any shape or dimensions that provide desired flow characteristics and residence time for the water.

Figure 4C:
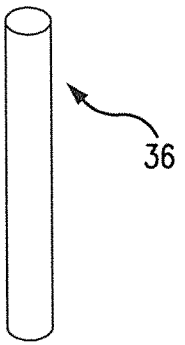
FIG. 4*c* is an isometric view of the heater liner of the first-stage heater shown in FIG. 3*a*.
Figure 4D:
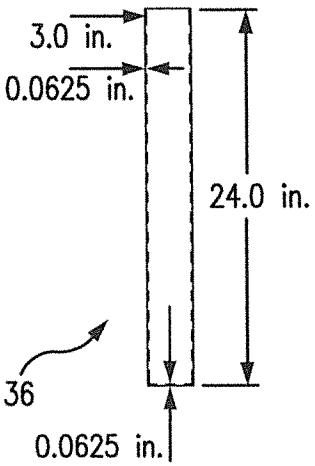
FIG. 4*d* is a side view of the heater liner of the first-stage heater shown in FIG. 3*a*.

The coiled tubing 40 may be placed into the heater liner 36 shown in FIGS. 4*c* & 4*d*. Preferably, the heater liner 36 comprises a stainless steel cylinder with one end open and one end closed with dimensions shown in FIG. 4*d*. The tubing 40 is designed so that the inlet and outlet ports are accessible from a top of the heater liner 36 and the insulated container 30. In this embodiment, the tubing 40 is a coil that is placed into the cylindrical coil and heater liner 36 and positioned at the center of the insulated containment vessel 30, where it is stabilized. In this embodiment, the heater 42 comprises five high watt density rod heaters 42 that are preferably inserted into an open end of the heater liner 36 in a pentagonal array such that they are evenly spaced within the volume of the cylinder and within the heavy wall coiled tubing 40. Note that by placing heaters within the heater liner requires heat energy to flow from the interior to the exterior. Thus, heat energy must pass through or by the coiled tubing before it can be lost by conduction and convection to the outside. Heat loss to the outside is further reduced by the external band heaters 34 and Microtherm® free flow insulation 32. While five heaters are shown in this embodiment, the heaters 42 may comprise any number of heaters, not necessarily five, and may not necessarily be arranged in the pentagonal array and may be arranged in other configurations and/or arrays depending on a desired result.

Once the stainless steel tubing 40 and high watt density heaters 42 are positioned, the thermally conductive powder 38 is poured into the heater liner 3*b* to fill the void and stabilize the tubing 40 and heaters 42. In an embodiment of this invention, the conductive powder 38 comprises a finely-divided spherical copper powder such as provided by Acupowder International in Grade #154. In alternative embodiments, other arrangements exist for positioning different numbers of different heaters within the tubing. The fine copper powder functions as a high-efficiency thermal transfer media and enables the use of compact high watt density heaters in a water heating application which would not typically be advised due to the limited heat transfer to water in systems that employ more conventional designs. The very fine copper powder allows the compact high watt density heaters 42 to maintain a sheath operating temperature below and well within proper operational parameters while concurrently providing an even heat distribution throughout the very fine copper powder, and thereby throughout the water-filled coils, in order to heat the flowing water to the specified temperature prior to discharge from the first-stage water heater 16. In alternative embodiments, the conductive powder 38 may comprise other forms of finely-divided, high thermal conductivity materials such as silver, gold, aluminum metals and high thermal conductivity ceramics such as beryllium oxide. In an alternative embodiment, the thermally conductive powder may comprise a metal that liquefies at or below an operating temperature of the water heater to facilitate heat transfer from the high watt density heater to water in the tubing.

As best shown in FIG. 3*a*, high wattage circular band heaters 34 deployed around the coil and heater liner 36. The band heaters 34 can be employed to provide additional heating, as necessary, to stabilize system performance and minimize outward heat flow through the coil and heater liner 36. A volume between the band heaters 34 and inside diameter of the insulated containment vessel 30 is preferably filled with a free flowing granular insulation 32 which has a very low thermal conductivity to minimize heat loss. If needed, for conditions in which heat loss is minimal and water flow is high, the band heaters 34 can also be used to provide additional heat to the flowing water in the tubing 40.

Figures 2A, 2B, 2C:
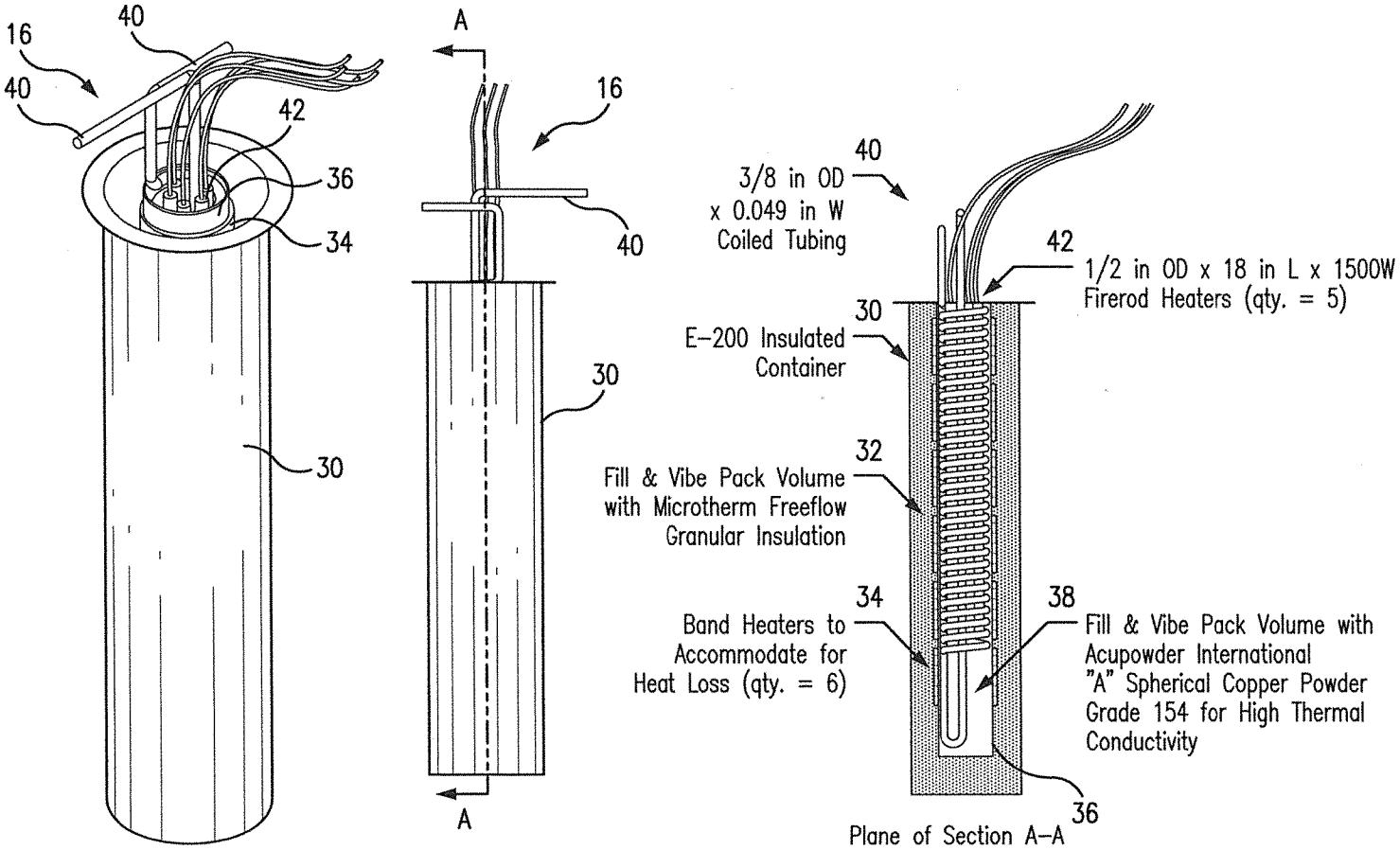
FIG. 2*a* is an isometric drawing of a first-stage heater according to an embodiment of this invention.
FIG. 2*b* is a side view drawing of the first-stage heater shown in FIG. 2*a*.
FIG. 2*c* is a cross-sectional view of the first-stage heater shown in FIG. 2*a*.
Figure 4E:
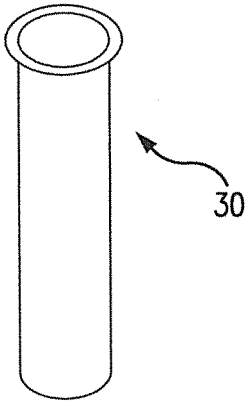
FIG. 4*e* is an isometric view of an insulated container of the first-stage heater shown in FIG. 2*a*.
Figure 4F:
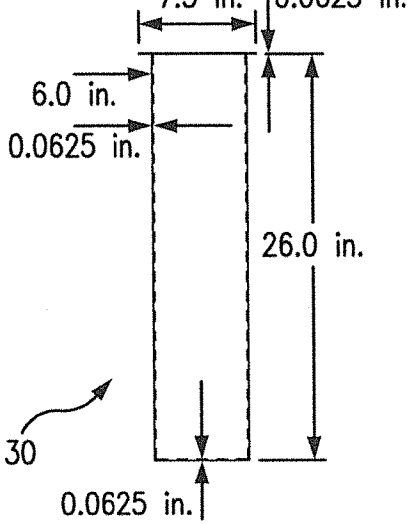
FIG. 4*f* is a side view of the insulated container of the first-stage heater shown in FIG. 2*a*.

As best shown in FIGS. 2*c*, 4*e*, and 4*f* the insulated containment vessel 30 provides a housing for the other components of the first-stage high watt density heater 16 and prevents heat loss loan the heater 16. In this embodiment, the insulated containment vessel 30 is a cylinder with an open end surrounded by a lip. The insulted container 30 of this embodiment includes dimensions shown in 4*f*. However, the insulted container 30 is not limited to the described shape and/or dimensions and may include any shape or dimensions necessary for a particular application. The first-stage high watt density heater 16 of this invention also utilizes a low thermal conductivity, free-flowing granular insulation 32, such as provided by MicroTherm®, which is packed between the heater liner 36 and the insulated container 30 to increase energy efficiency by minimizing heat loss from the first-stage high watt density heater 16.

A preferred embodiment of the high pressure, high temperature system 10 of this invention allows a discharge of the first-stage high temperature water heater 16 to be preferentially directed to a pressure safety valve 44 (PSV-201) or to the second stage water heater 18. The pressure so bay valve 44 (PSV-201) provides a conduit to an atmospheric relief vent.

Figure 5A:
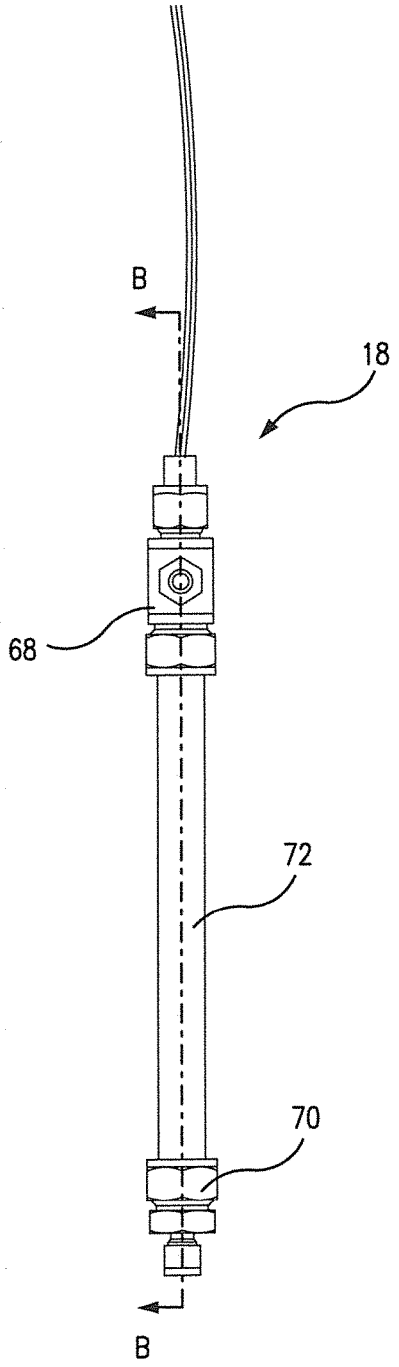
FIG. 5*a* is a side view of a second-stage heater according to an embodiment of this invention.
Figure 5B:
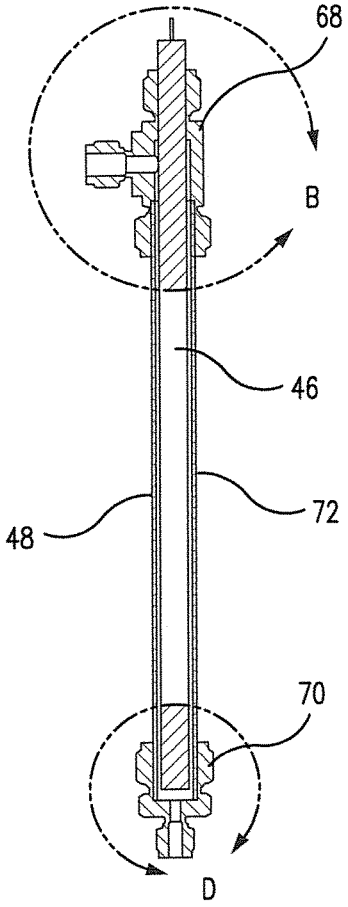
FIG. 5*b* is across-sectional view of tire second-stage heater shown in FIG. 5*a*.
Figure 5C:
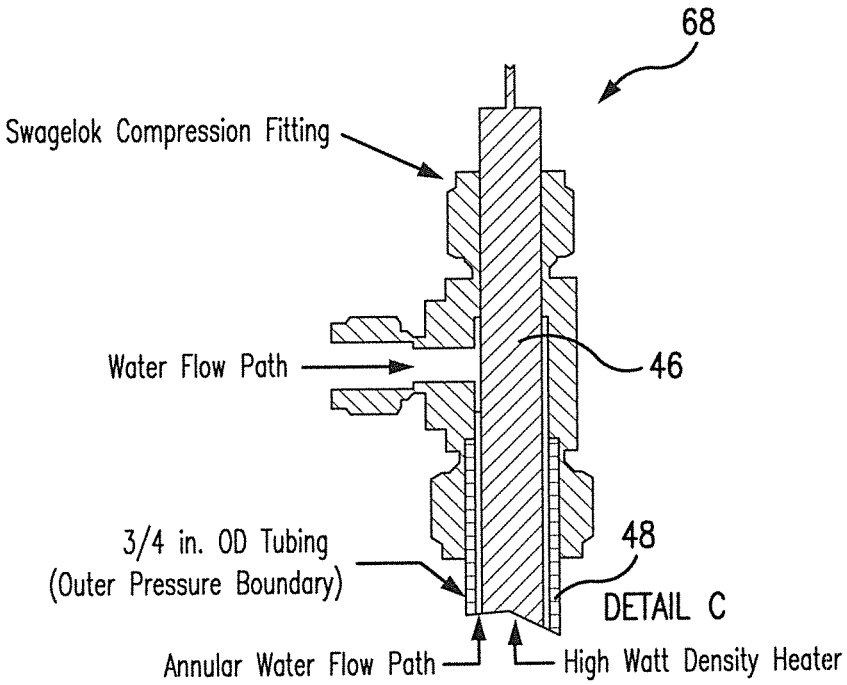
FIG. 5*c* is a cross-sectional detail view of an inlet of the second-stage heater shown in FIG. 5*b*.
Figure 5D:
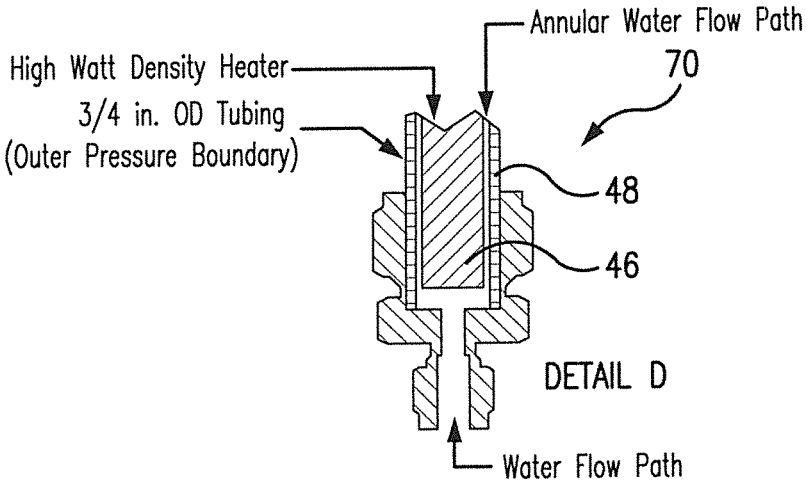
FIG. 5*d* is a cross-sectional detail view of an outlet of the second-stage heater shown in FIG. 5*b*.
Figure 6:
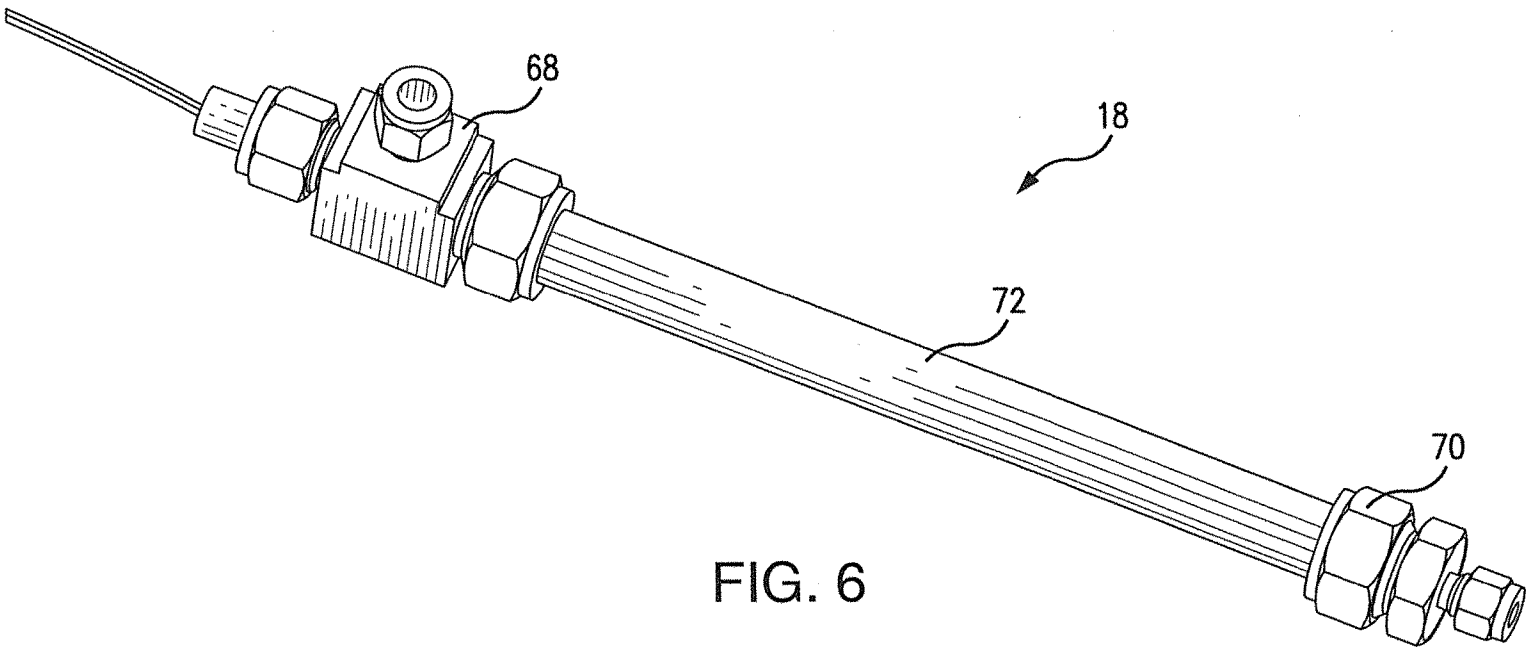
FIG. 6 is an isometric view of the second-stage heater shown in FIG. 5*a*.

FIGS. 5*a-d* show an annotated, detailed mechanical drawing and section view, with detailed callouts of the second-stage heater 18 according to a preferred embodiment of this invention, FIG. 6 shows an isometric rendering of the second stage heater 18. Preferably, the second-stage heater 18 is designed to increase the temperature of the process water by a limited amount and to provide a high degree of control of an outlet temperature. In an embodiment, the second-stage heater 18 increases the high pressure, high temperature water stream by 20-50° C. and maintains the output temperature to within a range of ±2° C. during normal operating conditions. In an embodiment, the second stage heater 18 comprises two heaters connected serially and assembled such that the outer surface of the heater sheath is fully enclosed by process tubing, and thereby contacting the process water. Each of the second-stage heaters 18 preferably includes a pair of compression fittings 68, 70 positioned on either end of an outer pressure boundary tubing 72 and surrounding a high watt density heater 74 providing an annular water flow path between an internal surface of the outer pressure boundary tubing 72 and the outer surface of the high watt density heater 74. In an embodiment, as shown in FIG. 5*c*, an input of the second-stage heater 18 includes a right angle Swagelok compression fitting an end of a ¼ inch outer diameter tubing surrounding a ½ inch outside diameter Watlow Firerod® heater. As shown in FIG. 5*d*, an output of the second-stage heater 18 includes a linear Swagelok compression fitting on an opposite end of the ¼ inch outer diameter tubing. However, the second, stage heater 18 is not limited to these components and/or dimensions. The outer pressure boundary tubing 72 wall thickness, which changes an inside diameter (ID), and heater outside diameter are selected through an iterative design process in which process media flow rates, Reynolds numbers, total heater wattage, amperage, voltage, heater watt density, heater length, process pressure, and overall ΔT are used as variables, all of which affect the final configuration.

As preferred with the first stage heater 16, the annular water flow path, as shown in FIGS. 5*c* & 5*d*, is designed to induce turbulent flow across a heater sheath 46 of the high watt density heater 18 in order to maximize heat transfer away from the heater sheath 46 to the water. In an embodiment, the turbulent flow includes a calculated Reynolds number >2,000. In a preferred embodiment, 100% of the electrical energy that is converted to heat within the second-stage heater 18 is transferred through the process media (i.e. water). This is in stark contrast to externally heated known systems which typically expect heat losses of up to 60% of applied thermal energy. The preferred embodiment of the second-stage heater 18 provides for accurate control of the water by only requiring that it heat the water an additional 20-50° C. In this way, the preferred embodiment minimizes the risk of low temperature conditions due to improper proportional-integral-derivative (PID) loop tuning and temperature overshoot in the event of flow loss.

A preferred embodiment of the high pressure, high temperature, on-demand water heater system 10 of this invention further includes a high and low pressure switch which shuts off power to the heaters 16, 18. The high pressure shutoff minimizes the chance of a runaway condition caused by excessive localized temperature. In a preferred embodiment, the low pressure shutoff switch will limit the risk of heater damage in the event of a diminished water level due to a loss of water pressure.

As shown in FIG. 1, the high pressure, high temperature, on-demand water heater system 10 of this invention includes a backpressure regulator 52 (CV-201). In a preferred embodiment, the backpressure regulator 52 allows upstream high pressure high temperature water to be maintained at a pressure well above saturation pressure within the high pressure, high temperature, on-demand water heater system 10. In an embodiment of this invention the backpressure regulator may be manufactured by Equilibar, Inc. The preferred embodiment maintains the high pressure, high temperature, on-demand water heater system 10 at specified water pressure above that of the process into which HPHT water is added, independent of the system temperature. The preferred embodiment also allows for the specified water pressure to be maintained as a differential pressure across a sealing diaphragm within the backpressure regulator and also be unaffected by multiphase flow. As such, a preferred embodiment of the backpressure regulator 52 allows for the high pressure, high temperature, on-demand water heater system 10 to maintain water in liquid phase at up to 450° C., above the critical point of water, at an inlet of the backpressure regulator 52 and allows for either steam/liquid or liquid to be discharged without affecting upstream system stability. It is also important to note that the preferred embodiment of the backpressure regulator 52 is unaffected by the change of phase of the liquid discharged from the backpressure regulator 52 even if the phase changes during operations due to downstream (e.g. downstream connected processes) changes and/or upsets. This is important and unexpected because standard control theory teaches that controlling multiphase and changing phase flow during process operations is not a condition readily accommodated by most control valves and therefore by most upstream supply systems. The preferred embodiment of the high pressure, high temperature, on-demand water heater system is unaffected by downstream process upsets and changes of phase of media discharged from the backpressure regulator 52.

A preferred embodiment of this invention further comprises a second backpressure regulator 54 (CV-203) which functions as a process side pressure relief valve. The preferred embodiment of the system 10 utilizes the second backpressure regulator 54 to allow efficient point of use preheating of system lines and components and to function as a low-pressure relief valve for the system. This allows the system 10 to rely on a true pressure safety valve 44 (PSV-201) to initiate a system shutdown when activated.

In a preferred embodiment, the system 10 of this invention includes a plurality of temperature controllers 58, 60, 62 for the first stage water heater 16 and the second stage water heater 18. The temperature controllers 58, 60, 62 preferably each include a process controller. In an embodiment, electrical resistance heaters, used in each of the first stage water heater 16 and the second stage water heater 18, are controlled by the process controllers configured to accept temperature measurements as inputs and provide a 0-10V or 4-20 mA output. The process controllers used in the preferred embodiment preferably utilize an auto-tuning PID loop method which readily accommodates changing process media flow rates and thereby the rate of heat transfer and heat input. The system 10 shown in FIG. 1 includes three separate temperature controllers 58, 60, 62. Two of the temperature controllers 58, 60 monitor the first stage water heater 16 and one of the temperature controllers 62 monitors the second stage water heater 18. Each temperature controller relies on a direct temperature measurement made by measuring the change in resistance of a Type-K thermocouple (i.e. temperature sensing element: TE). Information supplied by the temperature sensing element is used by the temperature controllers to close a control loop and send a signal to the heater controller to either increase or decrease the applied power to the heating elements to maintain water output at a desired set point.

A preferred embodiment utilizes a power controlling method known as variable phase angle control to manage the applied voltage to each heating zone. This method was preferentially chosen due to its ability to extend the service life of heaters in severe applications. The preferred embodiment of the controllers also utilizes an inline latching high temperature alarm which removes power to all heaters in the system if an over-temperature condition is sensed.

A preferred embodiment of the high pressure, high temperature water heater 10 has been applied to hydrothermal carbonization of biomass. The system 10 is preferred for this process because water can be pressurized and heated independent of any downstream processes and remain unaffected by downstream process pressures which may occur during secondary system startup and/or process upsets. However, the high pressure, high temperature water heater system 10 of this invention is not limited to the hydrothermal carbonization of biomass. The compact and efficient system of this invention can be utilized in the commercial or research and development industries as a compact, energy efficient point-of-use (POU) high pressure high temperature water supply to provide either single-phase flow hot water, multi-phase flow steam and water or single phase flow high-quality steam. The ability of this system 10 to operate in a safe and efficient manner, while delivering water at very high pressures and temperatures, allows the unit to produce a very high-quality, high pressure discharge product in the form of steam while never creating steam within the HPHT water system. This novel, unconventional approach could be useful for fixed and/or transportable POU cleaning, sanitizing or to supply commercial fluidized-bed gasification (steam for fluidization) and power generation systems with high-quality steam without requiring the installation and expense of large centralized boilers and extensive steam distribution systems.

It is well known that liquids require additional energy to change phase and convert from a liquid to vapor and that this energy is recovered as the phase change is reversed. Likewise, it is also well known that heat losses and kinetic energy losses occur during transmission and can cause steam to change phase and condense to a liquid. In conventional use, this liquid is removed via automatic and unregulated steam taps. Liquid that is discharged and the energy lost during phase change from steam to water creates loss of efficiency and thereby loss of probability.

The technology of this invention is a novel, highly compact, energy-efficient approach for producing high pressure, high temperature water. This water can be used directly to provide heat and or reaction media for many processes ranging from industrial cooking, cleaning, sanitizing, chemical reaction technology, and/or chemical production without the need to install expensive large scale boilers or pressure vessels.

Other applications permitted by this invention include the ability to inject high pressure high temperature dissolved gases and liquids into downstream processes. This is particularly valuable for high pressure high temperature reaction chemistry. For example, it is well known that gases have a maximum mass which can be dissolved into any given liquid but that the amount of a specific gas that can be adsorbed in a particular liquid can be a complicated function of the local temperature and pressure of the gas and the liquid carrier. It is clear to one skilled in the art that the system taught in this application and the embodiment shown in FIG. 1 readily accepts the injection of gases and/or liquids other than water into a carrier liquid. Therefore, the level of temperature control that is permitted by this invention allows for maintaining HPHT water at a point where no more or less than a predetermined amount of a gas can be adsorbed into the water. The system taught in this application employs preferential embodiments that involve the heating and delivery of HPHT water. However, one skilled in the art will also realize that liquids other than water can be processed by a system such as the one taught in this application. For example, instead of water, any carrier liquid that does not decompose or react when heated in the manner taught in this application should be a suitable material for the technology disclosed in this application, including the control of the precise amount of gases adsorbed into HPHT liquids other than water.

The injection of liquids (including water and liquids other than water) into the system taught by this application can readily be accommodated. For example, a variety of system-compatible liquids can be injected between the water softener 12 and the pump 14 in a low-pressure, low-temperature configuration. Liquids can also be injected in a high pressure, low-temperature configuration by being introduced between the pump 14 and the first stage water heater 16 through an appropriate high pressure pump or by other appropriate means. Finally, liquids can be injected into a high pressure, high temperature condition by being introduced by an appropriate means between the second stage water heater 18 and the back pressure regulator 52. Depending on the heat transfer properties of the liquids involved and the desired chemical reactions, each of the injection schemes described above could provide an opportunistic choice.

The injection of gases can be carried out in a manner similar to that of liquids described above. As taught in this invention and discussed above, the ability to control the pressure and temperature profile of the novel process water heater in an accurate and independent manner also provides a means for adsorbing a higher percentage of gases into liquids than would be possible in conventional configurations. For example, it may be necessary to inject a certain gas at a high pressure and low temperature between the pump 14 and the first stage water heater 16 and allow the mixture to heat together to permit certain reactions or to create preferential turbulence regimes that encourage or inhibit certain reactions. Alternatively, it may be preferred to avoid negative chemical interactions on heater surfaces with certain gases, such as $H_2S$. In this case the gas could be injected between the second stage water heater 18 and the back pressure regulator 52.

Figure 7:
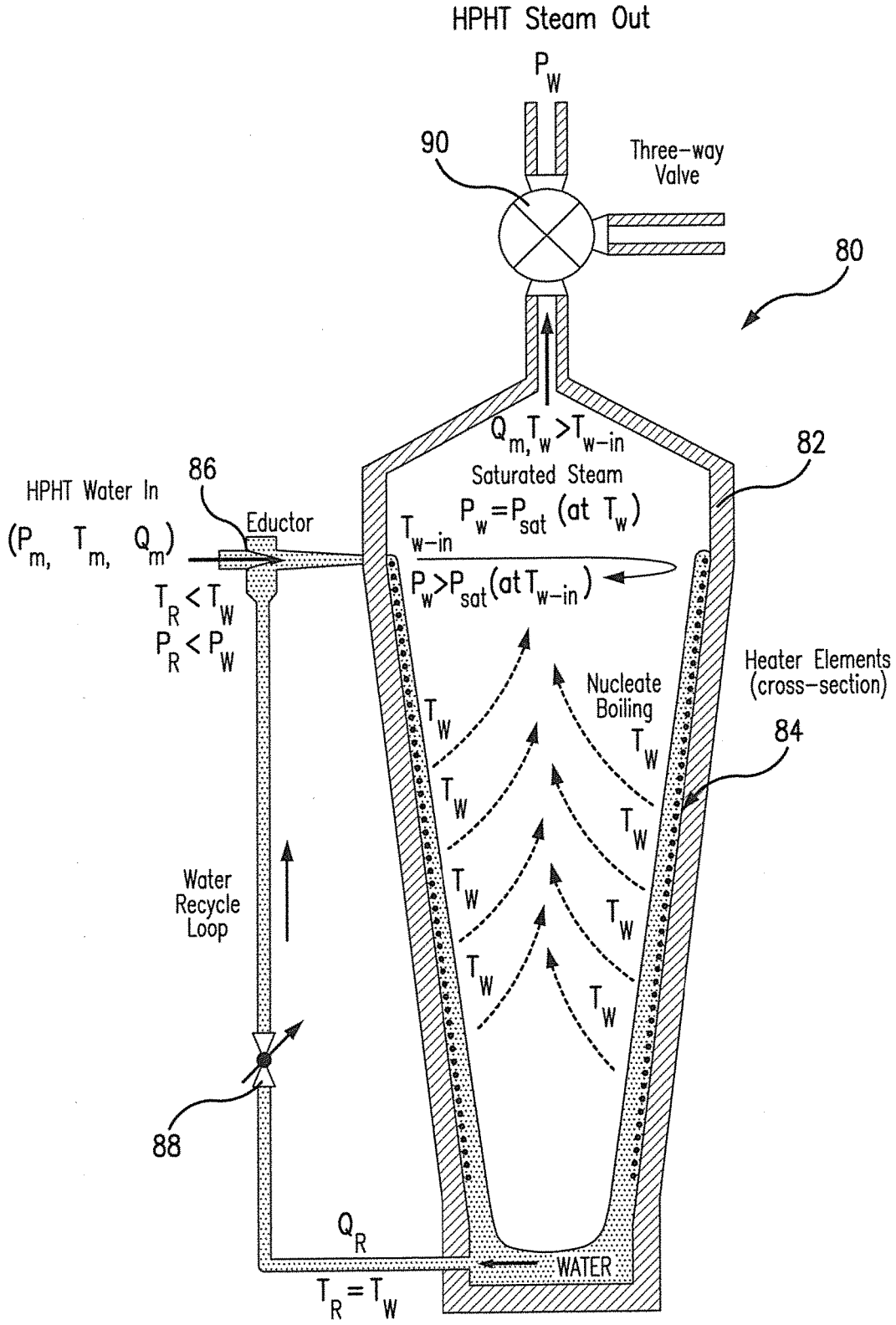
FIG. 7 is a cross-sectional drawing of a high pressure, high temperature water vaporizer according to an embodiment of this invention.

In another embodiment of this invention, the high pressure, high temperature on demand water heater 10 may be used to produce steam. FIG. 7 shows an embodiment of a high quality, high pressure, high temperature water vaporizer 80 that may be used with the high pressure, high temperature, on-demand water heater system 10 to deliver water that is efficiently converted into a known quantity of high pressure, high temperature steam, in the following discussion, the term "water" refers only to liquid-phase $H_2O$ while the term "steam" refers only to vapor-phase $H_2O$.

While the high pressure, high temperature on-demand water heater 10 enables the production of very high pressure and high temperature liquid water, when the high pressure, high temperature water at some saturation temperature and pressure (for example, 320° C. and 113 bar) is exhausted to a lower saturation pressure and temperature (for example, 240° C. and 33.4 bar), a portion of the water will flash to steam while the other portion of the water will remain as water, the exact amount being governed by the local saturation pressure and temperature. After flashing, the portion of high pressure, high temperature water that remains as water can be utilized in another process, flashed to ambient and ultimately recycled or exhausted as process waste, or supplied with additional heat energy to convert it into steam at the original high pressure, high temperature delivery pressure and temperature or greater, so that all of the high pressure, high temperature water can be delivered as a high-quality steam product. The latter option, however, can be quite energy intensive, particularly when considering the heat of vaporization, $H_{vap}$. Using the above example, vaporizing water at 232° C. ($H_{vap}$=31.809 kJ/mol), requires 72% more heat energy than vaporizing HPHT water (320° C., $H_{vap}$=18.502 kJ/mol). Indeed the heat of vaporization of water increases significantly as its temperature is lowered (e.g. at 25° C., $H_{vap}$=44 kJ/mol). Therefore, to minimize the amount of energy required to convert water into steam, water should be raised to the highest possible temperature before being converted to steam.

Therefore, if the production of pure steam is desired, it is a better choice to start with high pressure, high temperature water, and add sufficient heat energy to vaporize the water. This is the motivating reason for developing the high pressure, high temperature steam generator 80 shown in FIG. 7. Passing high pressure, high temperature water through an appropriate heat exchanger can provide superheated steam.

In the embodiment of FIG. 7, hot water, produced using the high pressure, high temperature water heater 10 of FIG. 1, at pressure $P_m$, temperature $T_m$, and flow rate $Q_m$, is injected into a compact heated chamber 82 at a temperature $T_{w\text{-}in}$ at pressure $P_w$ which is above the local saturation pressure $P_{sat}$ so that the water remains a liquid. Within the chamber 82, the water is quantitatively converted to saturated steam that is exhausted at flow rate $Q_m$ by additional heating to temperature $T_{w\text{-}in}$ with which $P_{sat}$ is raised to match $P_w$ plus sufficient heat to form steam at pressure $P_w$. In one preferred embodiment, the chamber 82 geometry comprises a conical section with its axis oriented vertically and a larger diameter at the top. In this embodiment, the chamber 82 includes a spirally wound cable heater 84 is attached to or slightly embedded in an interior wall of the chamber 82 so that a continuous spiral channel is formed between adjacent heater elements. In this embodiment, an educator 86 is used to inject high pressure, high temperature supply water and recycled, water tangentially into the spiral channel at one or more locations vertically dispersed along the length of the conical section. The water is injected with a velocity sufficient to produce a descending, circular spiraling flow that adheres to and flows around the conical chamber 82 wall within the channel(s) defined by adjacent heater coils. In this embodiment, the centrifugal force imparted to the water dominates a downward gravitational force on the water to forcibly maintain the water against the walls of the cone. In this embodiment, a sufficiency of water continuously flows downward within the circular channel so that by the heat supplied by the heater element 84, the water undergoes nucleate boiling and produces steam. Sufficient water remains to accumulate in a small reservoir at the bottom of the cone. In another embodiment, more than one heating element may be employed to define separate, independent flow channels. For multiple points of entry, the velocity of each injected stream of water is maintained at a high enough value to counterbalance the gravitational pull on the water and keep the stream of water within the spiral paths defined by the coiled heater. Heater power is sufficient to heat the injected water to saturation temperature $T_w$ at pressure $P_w$ and induce nucleate boiling creating steam at the overall rate, $Q_m$. The flow rate of the spiraling water stream, $Q_m+Q_R$, is sufficient to submerge the heaters in the high pressure, high temperature water and fast enough to immediately entrain or separate steam formed at the heater surfaces by nucleate boiling. Steam is evolved from the water surface to exit the chamber at the top of the conical chamber. Water that collects at the bottom of the chamber and recycled back to the water injection stream at temperature $T_R$ ($T_R<T_w$) such that flashing a portion steam is avoided. Water is mixed with the incoming high pressure, high temperature water supply which maintains the overall steam output at flow rate $Q_m$.

In one embodiment, the recycling/pumping function is performed by an eductor pump 88, as shown in FIG. 7. Recycled water leaves the steam chamber at pressure $P_w$ and saturation temperature $T_w$ at the bottom of the steam chamber while the pumping function up to the injection point lowers pressure to a pressure $P_R$, less than $P_m$ and $P_w$. In the water supplied to the narrow section (throat) of the eductor, water introduced at flow rate $Q_m$, is mixed with recycled water, at flow rate $Q_R$, and pressure in the throat is raised to Pw by the motive flow of the supply water at pressure $P_m$. The temperature of the supply water $T_m$ is selected so that mixing with recycled water, $Q_R$, is maintained at temperature $T_{w\text{-}in}$.

In the embodiment of FIG. 7, high pressure, high temperature steam is exhausted through the top of the generator 80 through a suitable pressure-reducing valve 90, or backpressure regulator, to maintain the interior of the steam generator 80 at $P_w$. Note that at $T_w$, $P_w=P_{sat}$. The system described in this preferred embodiment utilizes unique backpressure regulators which enable the creation of system pressure that is independent of system temperature. This type of backpressure regulator is utilized in the high pressure, high temperature on-demand water heater system 10 and has been described separately, above.

Should water impurities be present, impurity concentrations in the recycle water will be higher than water injected directly from the main supply, $Q_m$. In this situation, the level of impurities can increase over time. To avoid situations where these impurities accumulate to the point where they could create mineral deposits within the steam generator, water collected at the bottom of the heating chamber can be discharged and be replaced by increasing water flow to the stream generator, $Q_m$, by the amount of water that has been removed, $Q_R$.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A high pressure, high temperature water heater system comprising:

a pump providing pressurization of water;

an accumulator in fluid connection with the pump, wherein the accumulator dampens pulsations and pressure spikes produced by the pump to provide a constant, even flow of water;

a first-stage water heater in fluid connection with the pump, wherein the first-stage water heater comprises a heater liner enclosing a tubing and a plurality of high watt density heaters wherein the tubing is a coiled arrangement and surrounding the plurality of the high watt density heaters, the heater liner further includes a thermally conductive powder in contact with the tubing and high watt density heaters to facilitate efficient heat transfer from the high watt density heater to water in the tubing and the tubing is sized to create a turbulent flow of the water at a Reynolds number of at least 2000 at the operational flowrates of the pump;

a second-stage inline water heater in fluid connection with the first-stage water heater and including an annular flow path sized to create a turbulent flow of the water at a Reynolds number of at least 2000 at the operational flowrates of the pump;

a backpressure regulator in fluid connection with the second-stage inline water heater, wherein the backpressure regulator handles single and multiphase flow; and a fluid output.

2. The high pressure, high temperature water heater system of claim 1, further comprising a water softener to reduce mineral content of water.

3. The high pressure, high temperature water heater system of claim 1, wherein the pump comprises a positive-displacement variable speed, variable stroke piston pump.

4. The high pressure, high temperature water heater system of claim 1, wherein the tubing is sized to minimize nucleation and film boiling and allow for higher rates of heat transfer at the operational flowrates of the pump.

5. The high pressure, high temperature water heater system of claim 1, wherein the thermally conductive powder comprises copper.

6. The high pressure, high temperature water heater system of claim 1, further comprising a band heater positioned around the heater liner and the tubing.

7. The high pressure, high temperature water heater system of claim 1, further comprising an insulated container and insulation surrounding the heater liner.

8. The high pressure, high temperature water heater system of claim 1, further comprising a check valve to prevent fluid backflow and pressure loss during operation of the high pressure, high temperature water heater.

9. The high pressure, high temperature water heater system of claim 1, further comprising at least one of an isolation valve and a diverting valve which can be used during start-up and shutdown.

10. The high pressure, high temperature water heater system of claim 1, further comprising a pressure safety valve in fluid connection with a discharge of the first-stage water heater.

11. The high pressure, high temperature water heater system of claim 1, wherein the second-stage inline water heater comprises a pair of heaters connected serially and with each of the pair of heaters enclosed by a process tubing allowing water to pass between an outer surface of the respective heater and an inner surface of the process tubing.

12. The high pressure, high temperature water heater system of claim 1, further comprising a pressure switch to switch off power to at least one of the first-stage water heater and the second-stage inline water heater when either a pressure rises above a high pressure level or falls below a low pressure level.

13. The high pressure, high temperature water heater system of claim 1, further comprising a second back pressure regulator.

14. A high pressure, high temperature water heater system comprising:

a positive-displacement, variable speed, variable stroke piston pump providing water;

an accumulator in fluid connection with the positive-displacement variable speed, variable stroke piston pump, wherein the accumulator dampens pulsations and pressure spikes produced by the positive-displacement variable stroke piston pump to provide a constant, non-pulsating flow of water;

a first-stage high watt density water heater connected downstream of the pump, the first-stage high watt density water heater including a heater liner enclosing a coiled arrangement of tubing surrounding a plurality of high watt density heaters and a conductive powder in contact with the tubing and the high watt density heaters to facilitate heat transfer from the high watt density heaters to water flowing within the tubing and wherein the tubing is sized to create turbulent flow of the water at a Reynolds number of at least 2000 at the operational flowrates of the pump to enable efficient heat removal from walls of tubing to the water flowing in the tubing;

a second-stage inline water heater connected downstream of the first-stage water heater and including an annular flow path sized to create a turbulent flow of the water at a Reynolds number of at least 2000 at the operational flowrates of the pump; and a backpressure regulator connected downstream of the second-stage inline water heater, wherein the backpressure regulator handles single and multiphase flow.

15. The high pressure, high temperature water heater system of claim 14, wherein the first-stage high watt density water further comprises a band heater positioned around the heater liner.

16. The high pressure, high temperature water heater system of claim 14, further comprising an insulated container and an insulation surrounding the heater liner.

17. The high pressure, high temperature water heater system of claim 14, further comprising a check valve to prevent fluid backflow and pressure loss during operation of the high pressure, high temperature water heater.

18. The high pressure, high temperature water heater system of claim 14, further comprising at least one of an isolation valve and a diverting valve which can be used during start-up and shutdown.

19. The high pressure, high temperature water heater system of claim 14, further comprising a pressure safety valve in fluid connection with a discharge of the first-stage water heater.

20. The high pressure, high temperature water heater system of claim 14, wherein the second-stage inline water heater comprises a pair of heaters connected serially and assembled such that for each heater of the pair of heaters has an outer surface fully enclosed by process tubing and thereby contacting the water.

21. The high pressure, high temperature water heater system of claim 14, further comprising a pressure switch to switch off power to at least one of the first-stage water heater and the second-stage inline water heater when either a pressure rises above a high pressure level or falls below a low pressure level.

22. The high pressure, high temperature water heater system of claim 14, further comprising a second back pressure regulator.

23. The high pressure, high temperature water heater system of claim 14, further comprising a water vaporizer connected to a fluid output, the water vaporizer including a chamber with a heater positioned adjacent to a wall of the chamber.

24. The high pressure, high temperature water heater system of claim 1, further comprising a water vaporizer connected to the fluid output, the water vaporizer including a chamber with a heater positioned adjacent to a wall of the chamber.

* * * * *